United States Patent [19]

Lieb et al.

[11] 4,243,503

[45] Jan. 6, 1981

[54] METHOD AND ELECTRODE WITH ADMIXED FILLERS

[75] Inventors: Donald F. Lieb; Mary R. Suchanski, both of Mentor, Ohio

[73] Assignee: Diamond Shamrock Corporation, Dallas, Tex.

[21] Appl. No.: 937,724

[22] Filed: Aug. 29, 1978

[51] Int. Cl.[3] ..... C25B 11/16; C25B 11/06; C25B 1/36

[52] U.S. Cl. ..... 204/290 F; 204/291

[58] Field of Search ..... 204/290 F, 290 K, 290 R, 204/291

[56] References Cited

U.S. PATENT DOCUMENTS

| | | | |
|---|---|---|---|
| 3,627,669 | 12/1971 | Entwisle et al. | 204/290 F |
| 3,915,837 | 10/1975 | Feige | 204/286 |
| 3,917,518 | 11/1975 | Franks et al. | 204/95 |
| 3,943,048 | 3/1976 | Fisher et al. | 204/290 R |
| 4,028,215 | 6/1977 | Lewis et al. | 204/290 F |
| 4,061,549 | 12/1977 | Hazelrigg et al. | 204/98 |
| 4,064,331 | 12/1977 | Patton et al. | 429/221 |
| 4,072,586 | 2/1978 | De Nora et al. | 204/105 M |
| 4,086,157 | 4/1978 | Koziol et al. | 204/290 F |

FOREIGN PATENT DOCUMENTS

| | | |
|---|---|---|
| 2652152 | 5/1977 | Fed. Rep. of Germany . |
| 726324 | 8/1972 | South Africa . |

*Primary Examiner*—F. C. Edmundson
*Attorney, Agent, or Firm*—Bruce M. Winchell

[57] ABSTRACT

Disclosed is an electrode for use in electrochemical processes wherein a metal substrate made of a valve metal such as titanium carries an electrocatalytically active coating such as an oxide selected from the group consisting of manganese, iron, cobalt, or nickel applied in a series of layers wherein particles of fibers of various filler materials such as titanium, other valve metals, tin oxide, titanium oxides, manganese oxide, quartz, silica, and alumina were admixed with the top coating material.

5 Claims, No Drawings

METHOD AND ELECTRODE WITH ADMIXED FILLERS

BACKGROUND OF THE INVENTION

This invention generally relates to electrodes for use in electrochemical process, having a valve metal substrate carrying an electrocatalytically active coating such as a tin and antimony oxides semi-conductive intermediate coating with a top coating consisting of oxides selected from the group of manganese, iron, cobalt, and nickel admixed with particles or fibers of various filler materials to provide an electrode at considerably less cost while obtaining low cell voltages for given current densities. More particularly, the present disclosure relates to a much improved electrode having a valve metal substrate, such as titanium, carrying a semi-conducting intermediate coating consisting of tin and antimony compounds applied in a series of layers and baked to their respective oxides; and a top coating consisting of oxides of transition metals selected from the group consisting of manganese, iron, cobalt, or nickel applied in a series of several layers and baked into their respective oxide forms wherein particles or fibers of various filler materials such as titanium, other valve metals, tin oxide, tin and antimony oxides, titanium oxides, manganese oxide, quartz, silica, and alumina were admixed with the coating materials to improve catalyst-substrate adherence and increase the catalyst loading.

Electrochemical methods of manufacture are becoming ever increasingly important to the chemical industry due to their greater ecological acceptability, potential for energy conservation, and the resultant cost reductions possible. Therefore, a great deal of research and development effort has been applied to electrochemical processes and the hardware for these processes. One major element of the hardware aspect is the electrode itself. The object has been to provide: an electrode which will withstand the corrosive environment within an electrolytic cell; an efficient means for electrochemical production; and an electrode cost within the range of commercial feasibility. Only a few materials may effectively constitute an electrode especially to be used as an anode because of the susceptibility of most other substances to the intense corrosive conditions. Among these materials are: graphite, nickel, lead, lead alloy, platinum, or platinized titanium. Electrodes of this type have limited applications because of the various disadvantages such as: a lack of dimensional stability; high cost; chemical activity; contamination of the electrolyte; contamination of a cathode deposit; sensitivity to impurities; or high oxygen overvoltages. Overvoltage refers to the excess electrical potential at which the desired element is discharged at the electrode surface.

The history of electrodes is replete with examples of attempts and proposals to overcome some of the problems associated with the electrode in an electrolytic cell, none of which seems to have accomplished an optimization of the desirable characteristics for an electrode to be used in an electrolytic cell. Currently, in an electrowinning process, for example, the cell is operated at a relatively low current density of less than 1 ampere per square inch (155 milliamperes per square centimeter). The problem in this case is to find an electrode which will have many of the desirable characteristics listed above and additionally have a low half cell voltage at given current densities so as to conserve a considerable amount of energy in the electrochemical process. It is known, for instance, that platinum is an excellent material for use in an electrode to be used as an anode in an electrowinning process and satisfies many of the above-mentioned characteristics. However, platinum is expensive and hence has not been found suitable for industrial use to date. Carbon and lead alloy electrodes have been generally used, but the carbon anode has the disadvantage that it greatly pollutes the electrolyte due to the fast wearing and has an increasingly higher electrical resistance which results in the increase of the half cell potential. This higher half cell potential causes the electrolytic cell to consume more electrical power than is desirable. The disadvantages of the lead alloy anode are that the lead dissolves in the electrolyte and the resulting solute is deposited on the cathode subsequently resulting in a decrease in the purity of the deposit obtained, and that the oxygen overvoltage becomes too high. Another disadvantage of the lead alloy anode in the instance of copper electrowinning is that it is believed that the $PbO_2$ changes to a poor conductor. Oxygen may penetrate below this layer and flake off the film resulting in particles becoming trapped in the deposited copper on a cathode. This causes a degrading of the copper plating which is very undesirable.

It has been proposed that platinum or other precious metals be applied to a titanium substrate to retain their attractive electrical characteristics and further reduce the manufacturing costs. However, even this limited use of precious metals such as platinum which can cost in the range of about $30.00 per square foot ($323.00 per square meter) of electrode surface areas are expensive and therefore not desirable for industrial uses. It has also been proposed that the surfaces of titanium be plated electrically with platinum to which another electrical deposit either of lead dioxide or manganese dioxide be applied. The electrodes with the lead dioxide coating have the disadvantage of comparatively high oxygen overvoltages and both types of coatings have high internal stresses when electrolytically deposited which are liable to be detached from the surface during commercial usage, contaminating the electrolyte and the product being deposited on the cathode surface. Thus, the current density of such anodes is limited and handling of such anodes must be done with extreme care. Another attempted improvement has been to put a layer of manganese dioxide on the surface of a titanium substrate which is relatively porous in nature and building up a number of layers of the manganese dioxide to so as to present an integral coating. This yields relatively low half cell potentials as long as the current density remains below 0.5 ampere per square inch (77.5 milliamperes per square centimeter) but as the current density is increased to near 1 ampere per square inch (155 milliamperes per square centimeter) the half cell potential required rises rather rapidly on this type of electrode, resulting in a considerable disadvantage at higher current densities. Therefore, to date, none of these proposals have met with much commercial success basically because efficiencies and cost reductions desired have not been achieved to this point.

SUMMARY OF THE INVENTION

It is, therefore, an object of the present invention to provide a less expensive electrode having the desired operational characteristics which can be manufactured at a cost within the range of commercial feasibility.

Another object of the present invention is to provide an improved electrode for use in an electrolytic cell which will have better wear characteristics within the given cell environment and a longer electrode lifetime.

These and other objects of the present invention, together with the advantages thereof over existing and prior art forms which will become apparent to those skilled in the art from the detailed disclosure of the present invention as set forth hereinbelow, are accomplished by the improvements herein described and claimed.

It has been found that an improved electrode for use in an electrolytic cell can be made of a valve metal substrate selected from the group consisting of aluminum, molybdenum, niobium, tantalum, titanium, tungsten, zirconium, and alloys thereof; on the surface of at least a portion of said valve metal substrate, an electrocatalytically active coating selected from the group consisting of oxides of manganese, iron, cobalt, and nickel admixed with conducting particles or fibers.

It has also been found that an improved electrode for use in an electrolytic cell can be made of a valve metal substrate selected from the group consisting of aluminum, molybdenum, niobium, tantalum, titanium, tungsten, zirconium, and alloys thereof; on the surface of at least a portion of said valve metal substrate, an electrocatalytically active coating selected from the group consisting of oxides of manganese, iron, cobalt and nickel; said electrocatalytically active coating material admixed with nonconducting particles or fibers selected from the group consisting of tin oxide, alumina, silica, titanium oxides, and quartz to improve the adherence of said electrocatalytically active coating and to improve the amount of said electrocatalytically active coating material, which may be applied to any given surface area of said valve metal substrate.

It has also been found that method for manufacture of an electrode for use in an electrolytic cell can comprise the steps of: selecting a valve metal substrate from the group consisting of aluminum, molybdenum, niobium, tantalum, titanium, tungsten, zirconium, or alloys thereof; applying to at least a portion of the surface area of said valve metal substrate a semi-conductive intermediate coating of thermally decomposable compounds of tin and antimony containing 0.1 to 30 weight percent antimony, drying said semi-conductive intermediate coating; baking said semi-conductive intermediate coating in an oxidizing atmosphere at an elevated temperature to transform the tin and antimony compounds to their respective oxides; and applying on the surface of said semi-conductive intermediate coating a top coating consisting of oxides of transition metals selected from the group consisting of manganese, iron, cobalt, and nickel admixed with particles or fibers selected from the group consisting of valve metals, tin oxide, tin and antimony oxides, manganese oxide, titanium oxides, quartz, silica, and alumina.

DESCRIPTION OF THE PREFERRED EMBODIMENTS

The valve metal substrate which forms the base component of the electrode is an electroconductive metal having sufficient mechanical strength to serve as a support for the coatings and should have high resistance to corrosion when exposed to the interior environment of an electrolytic cell. Typical valve metals include: aluminum, molybdenum, niobium, tantalum, titanium, tungsten, zirconium and alloys thereof. A preferred valve metal based on cost, availability and electrical and chemical properties is titanium. There are a number of forms that the titanium substrate may take in the manufacture of an electrode, including for example: solid sheet material, expanded metal mesh material with a large percentage open area, and a porous titanium with a density of 30 to 70 percent pure titanium which can be produced by cold compacting titanium powder or by a sintering process. Porous titanium is favored by the prior art for its high surface area, but it is expensive. Solid sheet material or expanded metal mesh being the least expensive is preferred in the present invention where particles or fibers of various filler materials such as titanium, other valve metals, tin oxide, tin and antimony oxides, titanium oxides, manganese oxide, quartz, silica, and alumina were admixed with the coating material.

The preferred electrocatalytically active coating of the electrode is a transition metal oxide selected from the group of manganese, iron, cobalt, and nickel and can be applied by several methods such as dipping, electroplating, spraying, or other suitable methods. The coating can be layered to build up a thickness or weight per unit area as desired for the particular electrode. The coating material will generally be a solution of the desired compound which is applied to the surface of the substrate, dried, and then baked in an oxidizing atmosphere to produce the oxide of the selected transition metal.

A semi-conductive intermediate coating may be used to further enhance the catalyst-substrate adherence, particularly with manganese. Such a semi-conductive intermediate coating of tin and antimony oxides is a tin dioxide coating that has been modified by adding portions of a suitable inorganic material, commonly referred to as a "dopent." Dopent of the present case is an antimony compound such as $SbCl_3$ which forms an oxide when baked in an oxidizing atmosphere. Although the exact form of the antimony in the coating is not certain, it is assumed to be present as a $Sb_2O_3$ for purposes of weight calculations. The compositions are mixtures of tin dioxide and a minor amount of antimony trioxide, the latter being present in an amount of between 0.1 and 30 weight percent, calculated on the basis of total weight percent of $SnO_2$ and $Sb_2O_3$. The preferred amount of the antimony trioxide in such a coating is between 3 and 15 weight percent.

There are a number of methods for applying the semi-conductive intermediate coating of tin and antimony oxides on the surface of the valve metal substrate. Typically, such coatings may be formed by first physically and/or chemically cleaning the substrate, such as by degreasing and etching the surface in a suitable acid (such as oxalic or hydrochloric acid) or by sandblasting; then applying a solution of appropriate thermally decomposable compounds; drying; and heating in an oxidizing atmosphere. The compounds that may be employed include any inorganic or organic salt or ester of tin and the antimony dopent which are thermally decomposable to their respective oxide forms, including their alkoxides, alkoxy halides, amines, and chlorides. Typical salts include: antimony pentachloride, antimony trichloride, dibutyl tin dichloride, stannic chloride, and tin tetraethoxide. Suitable solvents include: amyl alcohol, benzene, butyl alcohol, ethyl alcohol, pentyl alcohol, propyl alcohol, toluene, and other organic solvents as well as some inorganic solvents such as water.

The solution of thermally decomposable compounds, containing salts of tin and antimony in the desired proportion, may be applied to the cleaned surface of the valve metal substrate by brushing, dipping, rolling, spraying, or other suitable mechanical or chemical methods. The coating is then dried by heating at about 100 degrees centigrade to 200 degrees centigrade to evaporate the solvent. This coating is then baked at a higher temperature such as 250 degrees centigrade to 800 degrees centigrade in an oxidizing atmosphere to convert the tin and antimony compounds to their respective oxides. This procedure is repeated as many times as necessary to achieve a desired coating thickness or weight appropriate for the particular electrode to be manufactured. For solid sheet titanium, the desired thickness can be obtained by applying 2 to 6 coats of the tin and antimony compounds. Alternatively, a desired thickness of the semi-conductive intermediate coating can be built up by applying a number of layers with drying between applications such that the baking process to convert the tin and antimony compounds to their respective oxides is preformed only once at the end of a series of layering steps.

The porous titanium substrate, so necessary in some coating systems of the prior art, is not necessary, however, when the titanium sheet is coated with an electrocatalytically active coating material of admixed particles or fibers to improve the catalyst to substrate adherence, and increase the catalyst loading by increasing the surface area of the substrate susceptible to coating with the top coating catalyst. This will save the costs of the porous titanium substrate material which is considerable while achieving the high top coating loadings necessary for good lifetime performance of the resulting electrode. It is contemplated that the particles or fibers may be admixed either with the top coating or the intermediate coating or both to achieve the enhanced surface area, catalyst loading and adherence. Contemplated particle or fiber materials include titanium, other valve metals, tin oxide, tin and antimony oxides, titanium oxides, manganese oxide, quartz, silica, and alumina.

These materials may be broken down into two groups basically to explain their functional characteristics. The first group may be referred to as conducting materials such as titanium metal, other valve metals, tin and antimony oxides, and manganese oxide. Depending on the method of preparation, titanium oxide may also be conducting. Basically, it is believed that the incorporation of these particles with the electrocatalytically active coating material increases the lifetime of the resultant electrode due to the catalyst loading being increased by the greater surface area produced by the particles. This, of course, cannot be accomplished with high percentages of admixed particles or fibers due to the loss of conductivity associated with high percentages of nonconducting materials in any given mixture. It is also believed that these admixed particles or fibers increase the adherence of the electrocatalytically active coating to the substrate material, which improves the wear characteristics of the resultant electrode.

The second group may be referred to as nonconducting materials such as tin oxide, silica, quartz, and alumina. Again, depending on the method of preparation, titanium oxide may also be nonconducting. It is believed that the incorporation of these particles with the electrocatalytically active coating material increases the surface area to provide higher loading of the catalyst, which, generally, significantly increases the lifetime of the resultant electrode. This, of course, cannot be accomplished to high percentages of admixed particles or fibers due to the loss of conductivity associated with high percentages of nonconducting materials in any given mixture. It is also believed that these admixed particles or fibers increase the adherence of the electrocatalytically active coating to the substrate material, which improves the wear characteristics of the resultant electrode.

Major uses of this type of electrode are expected to be in: the electrodeposition of metals from aqueous solutions of metal salts, such as electrowinning of antimony, cadmium, chromium, cobalt, copper, gallium, indium, manganese, nickel, thallium, tin, or zinc; production of hypochlorite; and in chloralkali cells for the production of chlorine and caustic. Other possible uses include: cathodic protection of marine equipment, electrochemical generation of electrical power, electrolysis of water and other aqueous solutions, electrolytic cleaning, electrolytic production of metal powders, electroorganic synthesis, and electroplating. Additional specific uses might be for the production of chlorine or hypochlorite.

In order that those skilled in the art may more readily understand the present invention and certain preferred aspects by which it may be carried into effect, the following specific examples are afforded.

EXAMPLE 1

A strip of titanium mesh weas degreased and etched in a boiling solution of HCl and distilled water (50:50). Three coats of Sn and Sb oxides were applied by brushing a solution of Sn and Sb sulfates onto the titanium sheet followed by thermal decomposition of the sulfates. The sulfate solution was prepared by mixing 30 ml of butanol, 9.7 grams of $SnCl_4.5H_2O$ (reagent analytical grade), 1.1 grams of anhydrous $SbCl_3$ and 6 ml of 98% $H_2SO_4$. Each coat was predried for 15 minutes at 120° C. and then baked for 15 minutes at 600° C. to convert the Sn and Sb sulfates to their oxides. Twelve coats of a 50% aqueous solution of $Mn(NO_3)_2$ were applied by brush to the titanium followed by heating at 235° C. for 15 minutes after each coating application. A total weight gain of 171 g/m$^2$ of $MnO_2$ was obtained. The anode lifetime in a solution of 150 gpl $H_2SO_4$ at 50° C. operating at a current density of 0.45 A/cm$^2$ was 28 hours.

EXAMPLE 2

A solid titanium sheet was cleaned and etched in a boiling solution of concentrated HCl and distilled water (50:50). Three coats of Sn and Sb oxides were applied by brushing a solution of Sn and Sb sulphates onto the titanium sheet followed by thermal decomposition of the sulphates in accordance with the procedure of Example 1. The sulphate solution was prepared by mixing 30 ml of butanol, 9.7 grams of $SnCl_4.5H_2O$ (reagent analytical grade), 1.1 grams of anhydrous $SbCl_3$ and 6 ml of 98% $H_2S_4$. Each coat was predried for 15 minutes at 120° C. and then baked for 15 minutes at 600° C. to convert the Sn and Sb sulphates to their oxides. Several grams of Sn and Sb oxides powder were prepared by evaporating most of the solvent from the Sn and Sb sulphate solution described above and then firing the resultant mixture at 600° C. overnight. The powdery grey product was screened through −325 mesh and 2.5 grams of the screened product was added to 20 ml of a 50% aqueous $Mn(NO_2)_2$ solution containing 0.2 grams of a cellulosic material marketed by Hercules Chemical under the trademark Natrosol 250H. The suspension was applied by brush to the substrate followed by heating for 15 minutes at 235° C. Seventeen such coats were applied to yield an anode with a total surface coverage of Sn/Sb oxide particles plus $MnO_2$ of 600 g/m$^2$. The anode lifetime in a solution of 150 gpl $H_2SO_4$ at 50° C. operating at a current density of 0.45 A/cm$^2$ was 245 hours. This compares with a lifetime of 28 hours under the same operating conditions of an anode prepared as described above with the exception that the Sn and Sb oxides powder was omitted, as seen in Example 1 above. Also, because of the Sn and Sb oxides powder, it can be seen that the $MnO_2$ catalyst loading was approximately 3.5 times higher.

EXAMPLE 3

A solid titanium sheet was cleaned and etched in a boiling solution of concentrated HCl and distilled water (50:50). Three coats of a mixture of Sn and Sb sulphates plus titanium powder were applied by brushing the mixture onto the titanium sheet followed by thermal treatment to decompose the sulphates. The sulphate solution was prepared by adding 2 grams of titanium powder (−100 mesh, Ventron, 99.9%) to 20 ml of the Sn and Sb sulphate solution prepared as in Example 1. Each coat was predried for 15 minutes at 120° C. and then baked for 15 minutes at 600° C. Three grams of Sn and Sb oxide particles were prepared by evaporating most of the solvent from the Sn and Sb sulphate solution described in Example 1 and then firing the resultant mixture at 600° C. overnight. The powdery grey product was ground and added to 20 ml of 50% aqueous $Mn(NO_3)_2$ and the suspension applied by brush to the substrate followed by heating for 15 minutes at 235° C. Twelve such coats were applied to yield an anode with a total surface coverage of Sn/Sb oxide particles plus $MnO_2$ of 1010 g/m$^2$. The anode potential vs. SCE in 150 gpl $H_2SO_4$ at 50° C. was 1.5 IV at 0.15 A/cm$^2$ and 1.56 V at 0.45 A/cm$^2$. The anode lifetime in a solution of 150 gpl $H_2SO_4$ at 50° C. operating at a current density of 0.45 A/cm$^2$ was 312 hours.

EXAMPLE 4

A solid titanium sheet was cleaned and etched in a boiling solution of concentrated HCl and distilled water (50:50). Three coats of Sn and Sb oxides were applied by thermal decomposition of the sulphates according to Example 1. A solution consisting of 2.0 grams of titanium powder (−100 mesh, Ventron, 99.9%) and 20 ml of 50% aqueous $Mn(NO_3)_2$ was applied by brush to the substrate and then the anode was heated at 235° C. for 15 minutes to decompose the $Mn(NO_3)_2$. Twelve such coats were applied to yield an anode with a total surface coverage of $MnO_2$ and titanium powder of 395 g/m$^2$. The anode potential in 150 gpl $H_2SO_4$, 50° C., corrected for iR solution resistance, was 1.49 V vs. SCE at 0.15 A/cm$^2$ and 1.54 V vs. SCE at 0.45 A/cm$^2$. The anode lifetime (measured as the time for the total cell voltage to reach 8 volts) in 150 gpl $H_2SO_4$ at 50° C. at a current density of 0.45 A/cm$^2$ was 118 hours.

EXAMPLE 5

A solid titanium sheet was cleaned and etched in a boiling solution of concentrated HCl and distilled water (50:50). Three coats of Sn and Sb oxides plus titanium particles were applied to the titanium sheet following the procedure in Example 3. A mixture of 2 grams $TiO_2$ powder, prepared by decomposing tetrabutylorthotitanate at 450° C. and 20 ml 50% aqueous $(Mn(NO_3)_2$ was applied by brush to the substrate and then heated at 235° C. for 15 minutes. Twelve such coats were applied to yield an anode with a surface coverage of $TiO_2$ and $MnO_2$ of 488 g/m$^2$. The anode potential vs. SCE in 150 gpl $H_2SO_4$ at 50° C. was 1.50 V at 0.15 A/cm$^2$ and 1.56 V at 0.45 A/cm$^2$. The anode lifetime in a solution of 150 gpl $H_2SO_4$ at 50° C. operating at a current density of 0.45 A/cm$^2$ was 184 hours.

EXAMPLE 6

A solid titanium sheet was cleaned and etched in a solution of boiling concentrated HCl and distilled $H_2O$ (50:50) and three coats of Sn and Sb oxides were applied following the procedure in Example 1. A mixture of 2 grams of silica fibers (Sargent-Welch) and 20 ml of 50% aqueous $(Mn(NO_3)_2$ was applied by brush to the substrate and then heated at 235° C. for 15 minutes. Twelve such coats were applied to yield an anode with a total weight gain of silica fibers plus $MnO_2$ of 225 g/m$^2$. The anode potential vs. SCE in 150 gpl $H_2SO_4$ at 50° C. was 1.48 V at 0.15 A/cm$^2$ and 1.56 V at 0.45 A/cm$^2$. The anode lifetime in a solution of 150 gpl $H_2SO_4$ at 50° C. operating at a current density of 0.45 A/cm$^2$ was 68 hours.

EXAMPLE 7

A solid titanium sheet was cleaned and etched in a solution of boiling concentrated HCl and distilled $H_2O$ (50:50) and three coats of Sn and Sb oxides were applied following the procedure in Example 1. A mixture of 2 grams $MnO_2$ particles and 20 ml of 50% aqueous $Mn(NO_3)_2$ was applied by brush to the substrate and heated for 15 min. at 235° C. The $MnO_2$ particles were prepared by thermally decomposing a solution of 50% aqueous $Mn(NO_3)_2$ at 235° C. to form a grey powder which was ground to a small particle size. Twelve coats of the $MnO_2$ powder + $Mn(NO_3)_2$ mixture were applied to the substrate to yield an anode with a total $MnO_2$ surface coverage of 660 g/m$^2$. The anode lifetime in a solution of 150 gpl $H_2SO_4$ at 50° C. operating at a current density of 0.45 A/cm$^2$ was 115 hours.

EXAMPLE 8

A control electrode was prepared from a strip of etched titanium mesh, which was coated with Sn and Sb oxides as described in Example 1. An approximately 50% aqueous solution of $Co(NO_3)_2$ was prepared by mixing 80 grams of $Co(NO_3)_2.6H_2O$ with 20 ml of distilled $H_2O$ and was applied by brush to the surface of the titanium substrate. The titanium strip was then heated for 15 minutes at 350° C. Twelve coats of cobalt oxide were applied according to this procedure to yield an electrode with a surface coverage of 205 g/m$^2$ $Co_3O_4$. The electrode was polarized anodically in a test cell containing dilute sulphuric acid (150 gpl of conc. $H_2SO_4$) maintained at a temperature of about 50° C. At applied current densities of 0.15, 0.45, and 0.75 A/cm$^2$ the anode exhibited potentials of 1.35, 1.39, and 1.42 volts vs. SCE (corrected for iR solution resistance), respectively. The lifetime of such an anode in 150 gpl $H_2SO_4$, 50° C. at a current density of 0.15 A/cm$^2$ was 34 hours.

EXAMPLE 9

A strip of etched titanium mesh was coated with Sn and Sb oxides as described in Example 1. A coating solution was prepared by adding 2.0 grams of titanium powder (−200 mesh, Cerac) to 10 ml of a 50% aqueous solution of $Co(NO_3)_2$. The mixture was applied by brush to the titanium substrate and the titanium strip was then heated for 15 minutes at 350° C. Twelve coats of cobalt oxide and titanium powder were applied to yield an electrode with a surface coverage of 661 g/m$^2$ ($Co_3O_4$+Ti particles). The electrode was polarized anodically in a test cell containing 150 gpl $H_2SO_4$ maintained at a temperature of about 50° C. At applied current densities of 0.15, 0.45, and 0.75 A/cm$^2$, the anode half cell potentials were 1.41, 1.43, and 1.45 volts vs. SCE, respectively. The lifetime of such an anode in 150 gpl $H_2SO_4$, 50° C. at a current density of 0.15 A/cm$^2$ was 56 hours.

EXAMPLE 10

A strip of etched titanium mesh was coated with Sn and Sb oxides as described in Example 1. A coating solution was prepared by adding 2.0 grams of chopped quartz wool fibers available from Sargent-Welch to 10 ml of a 50% aqueous solution of $Co(NO_3)_2$. The titanium strip was coated by brush with the mixture and then heated for 15 minutes at 350° C. Eleven coats of cobalt oxide and quartz fibers were applied to yield an electrode with a surface coverage of 723.0 g/m$^2$ $Co_3O_4$+quartz. The electrode was polarized anodically in a test cell containing 150 gpl $H_2SO_4$ maintained at a temperature of about 50° C. At applied current densities of 0.15, 0.45, and 0.75 A/cm$^2$, the anode half cell potentials were 1.42, 1.48, and 1.51 volts vs. SCE, respectively. The lifetime of such an amnode in 150 gpl $H_2SO_4$, 50° C. at a current density of 0.15 A/cm$^2$ was 61 hours.

Thus, it should be apparent from the foregoing description of the preferred embodiments that the composition hereindescribed accomplishes the objects of the invention and solves the problems that are attendant to such electrode compositions for use in electrolytic cells for electrochemical production.

What is claimed is:

1. An electrode for use in an electrolytic cell comprising: a valve metal substrate selected from the group consisting of aluminum, molybdenum, niobium, tantalum, titanium, tungsten, zirconium, and alloys thereof having on the surface of at least a portion of said valve metal substrate, an electrocatalytically active coating selected from the group consisting of oxides of manganese, iron, cobalt, and nickel having incorporated therein electrically conducting particles selected from the group consisting of tin and antimony oxides, titanium oxides, manganese oxide and valve metals.

2. An electrode according to claim 1 having a semi-conductive intermediate coating of tin and antimony compounds applied and converted to their respective oxides underneath said electrocatalytically active coating and has between 0.1 and 30 weight percent of antimony oxide based on the total weight of tin oxide and antimony oxide.

3. An electrode according to claim 2 wherein said semi-conductive intermediate coating of tin and antimony compounds has an amount of antimony oxide within the preferred range of 3 to 15 weight percent.

4. An electrode according to claim 3 wherein said electrocatalytically active coating is an oxide of manganese.

5. An electrode according to claim 4 wherein said admixed particles are made of titanium.

* * * * *